United States Patent [19]

Wright et al.

[11] 3,938,735

[45] Feb. 17, 1976

[54] CAPPING ASSEMBLY FOR THIN ALL CENTRIFUGE TUBES

[75] Inventors: Herschel E. Wright, Santa Clara; Kenzo Ishimaru, San Jose, both of Calif.

[73] Assignee: Beckman Instruments, Inc., Fullerton, Calif.

[22] Filed: Mar. 13, 1975

[21] Appl. No.: 557,949

[52] U.S. Cl. ..... 233/26; 233/1 A; 150/8; 128/214 D

[51] Int. Cl.[2] ..... B04B 15/00

[58] Field of Search ..... 233/26, 27, 1 R, 1 A; 23/292; 150/8; 128/214 D, 2 F

[56] References Cited

UNITED STATES PATENTS

| | | | |
|---|---|---|---|
| 3,071,316 | 1/1963 | Piemonte et al. | 233/26 |
| 3,195,932 | 7/1965 | Morton | 150/8 X |
| 3,285,308 | 11/1966 | Stambaugh | 150/8 |
| 3,366,320 | 1/1968 | Cho | 233/26 |
| 3,434,615 | 3/1969 | Barletta | 233/26 X |
| 3,459,369 | 8/1969 | Marks | 233/26 |

*Primary Examiner*—George H. Krizmanich
*Attorney, Agent, or Firm*—R. J. Steinmeyer; F. L. Mehlhoff

[57] ABSTRACT

A centrifuge test tube cap assembly for a thin flexible test tube including a stem member having a stud adapted to extend out the mouth of the test tube and having a cylindrically shaped skirt dimensioned to fit snugly within the inner surface of the mouth of the test tube, the stem member also having a slanting annular surface between the skirt and the stud, slanting outwardly in the downward direction, and the assembly also including a crown member having a depending outer lip, the outer diameter of which is substantially the same as the outer diameter of the thin flexible tube and having an annular inner surface slanting outwardly in the downward direction, the slanting surface of the lip conforming to the shape and slant of the slanting annular surface of the stem member so that when the crown is positioned over the stem and tightened axially on the stem member the upper edge of the flexible tube is deformed inwardly to squeeze the upper edge of the tube between the respective slanting surfaces of the stem member and the crown member to effect a fluid-tight seal.

4 Claims, 3 Drawing Figures

CAPPING ASSEMBLY FOR THIN ALL CENTRIFUGE TUBES

BACKGROUND OF THE INVENTION

1. Field of the Invention

This invention relates in general to test tube sealing caps of the type employed in centrifuge rotors and more particularly to a sealing cap for sealing the open end of a thin flexible test tube.

2. Description of the Prior Art

Analytical and preparative centrifuges are commonly provided with a rotor having a series of cavities, usually arranged in circular fashion, and adapted to receive test tubes for carrying a sample to be centrifuged. In a preparative centrifuge rotor, the axis of each cavity is angularly oriented with respect to the vertical rotational axis of the rotor so that the bottom of the test tube is further from the rotor axis than the top. An example of an angle head rotor is shown in FIG. 5 of U.S. Pat. No. 2,878,992 issued to Pickels et al. on Mar. 24, 1959 and assigned to the assignee of the present invention. Inclined-tube rotors are advantageous in that initially, precipitate is collected at the bottom of the tube at a more rapid rate than in a tube having its longitudinal axis perpendicular to the rotor axis were used.

During rotor operation, the sample is caused to climb up the outermost side of the tube wall and, eventually, if a sufficiently high rotational velocity is reached, the surface of the sample extends virtually parallel with the rotor axis. To prevent leakage of the sample from the tube, each test tube is provided with a cap sealing off the mouth thereof. It will be evident that if the test tube used in an angle rotor is initially full or almost full, leakage of the sample from the top of the test tube might occur unless the cap provides an adequate seal.

One form of centrifuge test tube cap assembly of the prior art includes a stem, a mating crown and a flat resilient washer, interposed between the stem and the crown. The stem is situated inside the upper part of the mouth of the test tube and the crown is dimensioned to fit snugly over the mouth. The stem and crown are coaxially coupled by suitable fastening means usually in the form of a crown-engaging nut threaded on a stud projecting from the stem. Between an upper surface of the stem and a lower surface of the crown is disposed a resilient washer which is compressed when the fastening nut is secured. Compression deforms the washer causing it to sealingly engage both the inner wall of the test tube and the stud projecting from the stem. The level of torque that is necessary to effect an adequate seal in such a test tube sealing cap is relatively high. In order to provide an effective seal, the tube must either be relatively stiff or the outer wall of the rotor cavity or a surrounding wall of the crown must be designed to support the centrifuge tube so that the resilient gasket produces a firm seal against the inner wall of the tube. When the centrifuge tube is relatively flexible, it is difficult to obtain a suitable seal in this fashion.

Thin wall centrifuge tubes rely to a certain extent on their contents for support. In lower "G" fields, the design of the capping system is based on the assumption that the volume of the tube cavity in the rotor and the volume of the tube contents are constant. In higher speed rotors which develop around half a million G's, the constant volume assumption is no longer valid. Under this high G loading, the rotor cavity stretches and increases its volume while the tremendous pressures on the fluid decreases its volume. This volume change of the sample fluid coupled with the volume increase in the size of the rotor cavity and tube allows the fluid surface to move down, depriving the tube of support at the upper end. If the tube cap assembly is not supported, in some manner other than by the tube, it may move down and sometimes results in a leakage around the cap. When the sample leaks from a tube which is flexible, it is likely to collapse. Therefore, it is necessary to design the tube cap assembly in such a manner that the tube cannot collapse into the rotor cavity when the tube leaks.

Accordingly, it is an object of the present invention to provide a new and improved tube cap assembly for a thin-walled flexible test tube.

It is a further object of the present invention to provide a test tube cap for a thin-walled relatively flexible test tube, which not only seals the mouth of the test tube, but also supports the tube within the rotor cavity and prevents collapsing of the tubes when the liquid level in the tube is lowered either by leakage or expansion under high G forces.

Further objects and advantages of the invention will become apparent as the following description proceeds, and these and other objects and advantages of the invention will become apparent from the following detailed description read in conjunction with the accompanying drawings.

DETAILED DESCRIPTION

Figure 2:
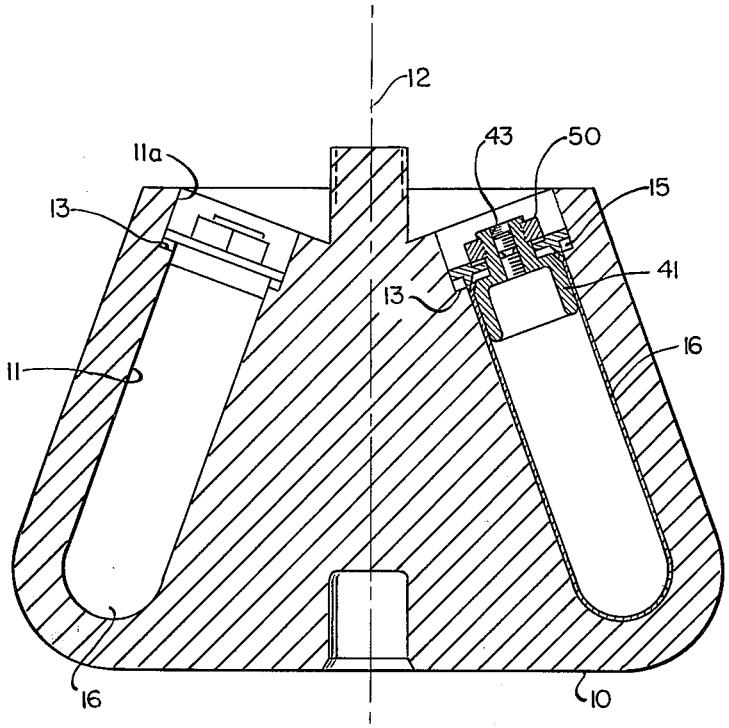
FIG. 2 is a vertical sectional view of a fixed angle preparative centrifuge rotor loaded with a test tube and cap assembly constructed in accordance with the present invention.

Turning now to the drawings, there is shown in FIG. 2 a typical preparative centrifuge rotor 10 of the type commonly designated as a "fixed angle" rotor. The rotor is provided with a plurality of cavities or wells 11 adapted to accept and carry a centrifuge test tube and to support a centrifuge test tube cap assembly. Each cavity 11 projects downwardly from and at some predetermined angle with respect to the rotational axis 12 of the rotor 10. In the preferred embodiment the rotor cavity is counterbored at the mouth thereof to provide a ridge 13 or shoulder means or other auxiliary support for the test tube cap assembly. As may best be seen in FIGS. 2 and 3, a centrifuge test tube 16 having a generally U-shaped cross-section may be positioned within each of the rotor cavities 11 of the rotor. The base or lower end of the test tube 16 is contoured to conform with the bottom of the cavity 11. This assists in preventing distortion of the lower extremities of the tube during centrifugation.

The test tube 16 for use with the capping assembly of the present invention is a thin-walled tube formed of a plastic such as a polyallomer plastic or other resilient material which may be deformed at least in the area of the mouth of the tube in order to receive the capping assembly of the present invention. As pointed out previously, if the sample contents of a flexible tube leak or the level of fluid decreases to any great extent, the tube is deprived of its support and may collapse. As will be described hereinafter, the test tube cap assembly of the present invention is designed to maintain an extremely strong fluid-tight seal at the mouth of the tube. In addition the tube cap assembly is designed to cooperate with the rotor cavity to prevent collapsing of the tube in the event the liquid level within the tube drops too low.

Figure 1:
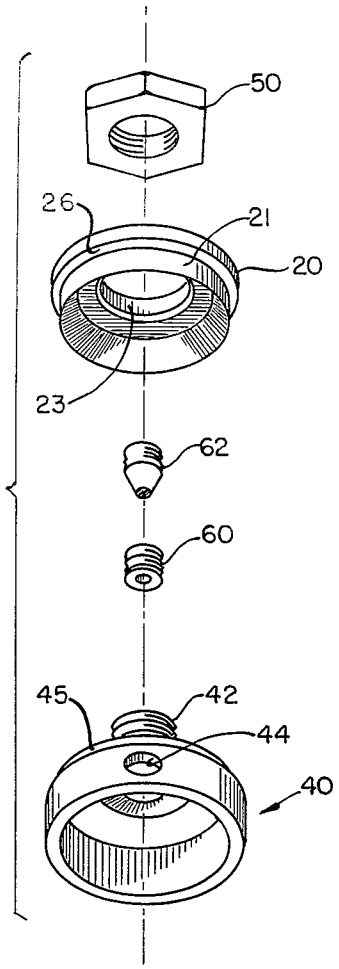
FIG. 1 is a perspective exploded view of a test tube cap assembly illustrating the present invention.

Referring now to the exploded view of FIG. 1, there is shown the capping assembly of the present invention, which comprises generally a crown member 20, a stem member 40, a clamping means or threaded clamping nut 50, an insert 60 and a set screw 62. The stem 40, shown in detail in FIGS. 1 and 3, has a downwardly extending cylindrical skirt or wall 41 dimensioned to fit snugly inside the mouth of the test tube 16. An axial threaded stud 42 having a threaded central bore or hole 43 therethrough projects upwardly from the upper surface 47 (seen in FIG. 3). A hole 44 in the downwardly extending cylindrical skirt 41 aids in breaking the seal which may exist between the surface of the downwardly extending skirt and the test tube when the cap assembly is removed. Between the downwardly extending cylindrical skirt 41 and the outwardly or upwardly extending stud is provided an annular surface 45 slanting outwardly in a downward direction toward the skirt. In the preferred embodiment of the invention this downwardly slanting surface is provided with a plurality of grooves 46 formed around the surface. The purpose of the grooves will be more clearly understood as the description proceeds.

Figure 3:
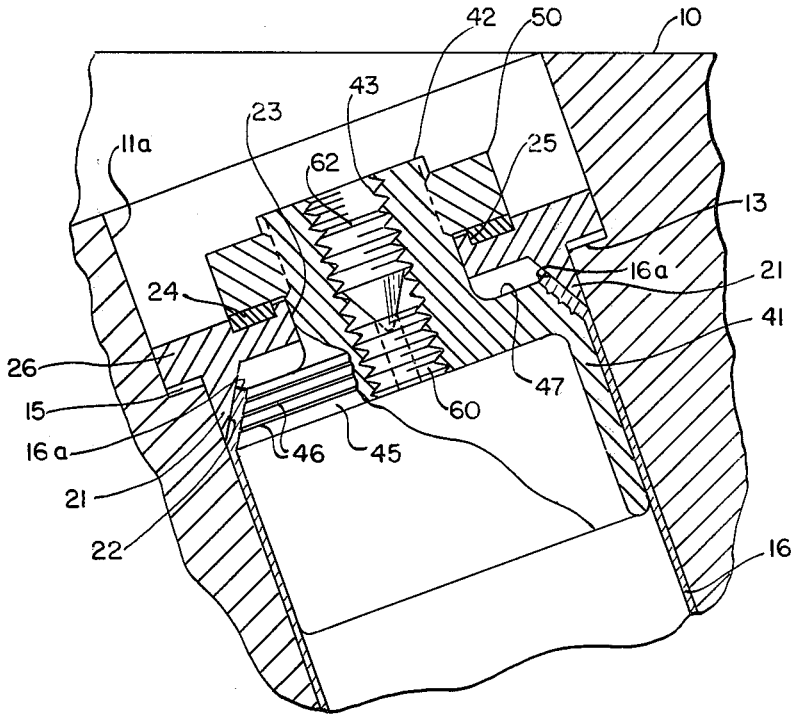
FIG. 3 is an enlarged cross-sectional view of a flexible test tube and the test tube cap assembly positioned within a rotor cavity.

The crown 20, the details of which are shown in FIGS. 1 and 3, has a generally cylindrical shape and is provided with a depending lip 21, the outer diameter of which is designed to be substantially the same as that of the outer diameter of the mouth 16*a* of the flexible centrifuge tube. The depending lip 21 slides easily into the cavity 11 of the rotor as does the test tube. As will best be seen in FIG. 3, the lip 21 has a wedge-shaped cross-section and is provided with an annular inner surface slanting outwardly in the downward direction. The surface 22 of the downwardly extending lip 21 slants or is angled outwardly to conform with the shape and slant of the slanting surface 45 on the stem member 40. The crown 20 is also provided with a cylindrical hole or opening 23 designed to receive the stud 42 of the stem member therethrough.

In order to facilitate attachment of the crown member to the stem member, an anti-friction washer 24 (seen only in FIG. 3) of Teflon or other suitable material is positioned within a groove 25 formed around the upper surface of the crown. The anti-friction washer 24 is of a thickness to permit it to extend slightly above the upper surface 47 of the crown.

In preferred practice, the capping assembly and the flexible tube 16 are joined prior to installation in the rotor cavity. During this procedure, the flexible tube 16 is placed in a suitable fixture and the stem 40 inserted therein. The upper surface 47 is positioned substantially flush with the upper edge or mouth 16*a* of the tube 16. The crown 20 is then placed over the stud 42 and moved downwardly against the tube so that the wedge-shaped downwardly extending lip 21 comes in contact with the mouth 16*a* of the tube. When the lip 21 contacts the mouth of the tube, the upper edge portion 16*a* of the tube is forced to deform inwardly. The clamping nut 50 is then positioned over the stud 42 and tightened down onto the surface of the anti-friction washer 24, thereby forcing the crown downwardly toward the stem member. As the crown member is moved downwardly toward the stem member, the upper edge of the tube is deformed into a right frustum of a cone by the wedge-shaped surface 22 of the downwardly extending lip of the crown. When the clamping nut is tightened the flexible tube is deformed into the grooves 46 and the end or mouth of the tube is squeezed between the inner surface 22 of the lip 21 and the surface 45 of the skirt. There is a certain amount of cold flow of the flexible tube into the grooves 46, depending upon the type of plastic used in the manufacture of the tube. the deformation of the tube at the mouth 16*a* and the pressure exerted between the surfaces 22 and 45 on the inner and outer surfaces on the upper edge of the tube create a fluid-tight seal and prevent movement of the tube away from the capping assembly.

After the stem member and crown have been attached to the mouth of the tube, the tube is loaded with a sample through the threaded hole 43 formed in the stud of the stem member. The threaded insert 60 is then screwed into the threaded hole 43. The threaded plug 60 is then sealed by inserting the tapered set screw 62 into the hole 43 and tightening it down against the hole formed in the insert 60. After loading, the tube and the cap assembly is positioned in the rotor 10 as indicated in FIGS. 2 and 3.

In order to permit a certain amount of relative movement between the tube capping assembly and the cavity of the rotor, the rotor cavity 11 is counterbored at its upper end thereof to form a larger section 11*a* which forms a shoulder or seat 13 at the juncture with the lower portion of the cavity. The larger section 11*a* of the cavity receives a larger diameter flange or flange 26 of the crown. When the tube and capping assembly is positioned within the cavity, the length of the tube and the relative size of the cavity is such that a clearance 15 is provided between the flange 26 of the crown and the abutment 13 leading to the narrower portion of the cavity. When rotating, the tube capping assembly may slide within the counterbore section 11*a* and thus decrease the clearance between the flange 26 and the shoulder 13 of the cavity. During normal operations, there is always a clearance 15 between the flange 26 of the crown and the shoulder 13 on the tube cavity. If, however, a leak does occur in the tube, the tube will collapse sufficiently that the crown or capping assembly will move downwardly within the cavity. When this happens, the flange 26 will come in contact with the shoulder 13 of the counterbore shoulder 11*a* and prevent the assembly from proceeding to the bottom of the tube cavity. Inasmuch as the mouth 16*a* of the tube is firmly retained between the surfaces of the stem member and crown member, this also prevents the tube from collapsing into the cavity and spilling the remaining contents of the tube.

It will be obvious to those skilled in the art that various modifications may be made in the specific exemplary embodiments of the invention described. While particular embodiments have been discussed, it will be understood that the invention is not limited thereto and that it is contemplated to cover in the appended claims any such modifications as fall within the true spirit and scope of the invention.

What is claimed is:

1. A centrifuge test tube cap for a thin flexible test tube comprising:

a stem member including a stud adapted to extend out of the mouth of the tube, said stem member including a cylindrically shaped skirt dimensioned to fit snugly within the inner surface of said test tube, said stem member also including an annular surface between said skirt and said stud slanting outwardly in the downward direction;

a crown member having an opening therein said stud of said stem member and having a depending lip, the outer diameter of which is adapted to be substantially the same as the outer diameter of said flexible test tube, said lip having a wedge-shaped cross-section with an annular inner surface slanting outwardly in the downward direction and substantially conforming with the shape and slant of said annular surface on said stem member, said wedge-shaped lip of said crown member being positioned over said stem member and being thereby adapted to cause the upper edge of said flexible tube to be deformed inward against said annular slanting surface of said stem member; and means for clamping together said stem member and said crown member whereby said upper edge portion of said flexible tube is squeezed between said respective slanting surfaces of said stem and said crown member.

2. the centrifuge test tube cap defined in claim 1 in which the annular slanting surface of said stem member is provided with a plurality of grooves so that the deformed upper edge of the flexible tube is caused to cold flow therein under pressure between said slanting surfaces of said stem and crown members.

3. The centrifuge test tube cap defined in claim 1 in which said clamping means includes threads formed on said stud and a threaded nut adapted to fit on said stud and tighten down an upper surface of said crown member to force said crown member toward said stem member.

4. the centrifuge test tube cap defined in claim 3 in which the crown member is provided with an upwardly facing flat surface surrounding the stud in which is mounted an anti-friction washer to provide a seat against which said threaded clamping nut may be tightened to cause said crown member and said stem member to move toward each other.

* * * * *

PO-1050
(5/69)

UNITED STATES PATENT OFFICE
CERTIFICATE OF CORRECTION

Patent No. 3,938,735 Dated February 17, 1976

Inventor(s) Herschel E. Wright and Kenzo Ishimaru

It is certified that error appears in the above-identified patent and that said Letters Patent are hereby corrected as shown below:

Claim 1, Column 5, Line 8, after "therein" insert --receiving--

Column 6, Line 2, after "stem" insert -- member --

TITLE: Change "ALL" to read -- WALL --

Signed and Sealed this

*eleventh* Day of *May 1976*

[SEAL]

*Attest:*

RUTH C. MASON
*Attesting Officer*

C. MARSHALL DANN
*Commissioner of Patents and Trademarks*